US007278461B2

(12) United States Patent
Endo et al.

(10) Patent No.: US 7,278,461 B2
(45) Date of Patent: Oct. 9, 2007

(54) MANUFACTURING METHOD OF TITANIUM COMPRESSOR WHEEL

(75) Inventors: Susumu Endo, Aichi (JP); Masaru Ogawa, Aichi (JP); Mitsuru Miyao, Aichi (JP)

(73) Assignee: Aikoku Alpha Corporation, Aichi (JP)

( * ) Notice: Subject to any disclaimer, the term of this patent is extended or adjusted under 35 U.S.C. 154(b) by 0 days.

(21) Appl. No.: 11/238,531

(22) Filed: Sep. 28, 2005

(65) Prior Publication Data

US 2007/0039709 A1 Feb. 22, 2007

(30) Foreign Application Priority Data

Aug. 19, 2005 (JP) ..... 2005-238644

(51) Int. Cl.
*B22C 9/02* (2006.01)
*B22D 33/04* (2006.01)

(52) U.S. Cl. ..... 164/76.1; 164/35; 164/45; 164/113; 164/137

(58) Field of Classification Search ..... 164/76.1, 164/35, 45, 113, 137
See application file for complete search history.

(56) References Cited

U.S. PATENT DOCUMENTS 4,107,257 A * 8/1978 Swin, Sr. ..... 264/275
6,171,418 B1 * 1/2001 Caramanian ..... 156/64
6,588,485 B1 * 7/2003 Decker ..... 164/35

FOREIGN PATENT DOCUMENTS

JP 2004052754 2/2004

* cited by examiner

*Primary Examiner*—Jonathan Johnson
*Assistant Examiner*—Ing-Hour Lin

(57) ABSTRACT

The present invention provides a manufacturing method of high precision titanium compressor wheel in which by removing pads attached on an entire surface entirely as a machining allowance in manufacturing process, dimensional accuracy at the time of manufacturing is intensified, and correction work of dynamic balance (rotation balance) is simplified or omitted so as to improve yield of products and suppress boosting of manufacturing cost. The outer peripheral face of a front cast boss portion of a cast titanium product is fixed with a chuck of lathe. A plurality of receiving plates projecting from the lathe are positioned between respective cast blades and front ends thereof are pressed against a disc-like large-diameter front end face formed on a rear half portion of a cast core portion. With a large-diameter front end face of the cast core portion and the outer peripheral face of the front cast boss portion as reference plane, the cast titanium product is held by the chuck and receiving plates and rotated. By turning the end face and outer peripheral face of a rear cast boss portion, the rear face and outer peripheral face of the cast core portion and trailing edges of cast full blades and cast splitter blades, portions corresponding to the pads at these portions are removed from the cast titanium product.

1 Claim, 13 Drawing Sheets

MANUFACTURING METHOD OF TITANIUM COMPRESSOR WHEEL

BACKGROUND OF THE INVENTION

1. Field of the Invention

The present invention relates to a manufacturing method of titanium compressor wheel used in automobile turbo charger and so on.

2. Description of the Related Art

For example, an automobile turbo charger has wheels 100, 200 on both end sides of a single rotary shaft 300 as shown in FIG. 2. Exhaust gas 250 discharged from a cylinder (not shown) of an engine is introduced to a wheel (turbine wheel) 200 and the turbine wheel 200 is rotated with exhaust gas pressure. The other wheel (compressor wheel) 100 is driven with that rotation force and the compressor wheel 100 compresses intake air 150 and supplies to an engine cylinder (not shown).

As shown in FIG. 1, this compressor wheel 100 comprises a front boss portion 101 and a rear boss portion 104 (see FIG. 13), fixed to a rotary shaft 300 (see FIG. 2) coaxially, a plurality of blades 102 extending radially from an inlet side 130 near the front boss portion 101 to an outlet side 140 outward in a radius direction and a disc-like core portion 103 extending outward in the radius direction at the rear boss portion 104 located on an opposite side to the inlet side 130 in an axial direction. The blade 102 is curved backward with respect to the rotation direction in order to compress intake air introduced in from the inlet side 130 and discharged from an outer peripheral portion of the outlet side 140. To intensify suction efficiency, long full blades 107 and short splitter blades 108 are arranged alternately and beginning end positions of both the blades 107, 108 are deviated. In the meantime, the blades 102 may be composed of only the full blades 107.

More specifically, the front boss portion 101 and the rear boss portion 104 have end faces 101*a*, 104*a* (see FIG. 11) and outer peripheral faces 101*b*, 104*b* (see FIG. 11). A shaft hole 109 goes through in the axial direction between the both end faces 101*a* and 104*a*. The core portion 103 has a hub face 103*a* serving as intake air flow face subsequent from the outer peripheral face 101*b* of the front boss portion 101, a back face 103*b* located on the back side of the hub face 103*a* (see FIG. 11) and an outer peripheral face 103*c* running along the outer edge of the core portion 103.

In the full blade 107 and splitter blade 108, pressure faces 107*a*, 108*a* are formed on upward sides in the rotation direction and negative pressure faces 107*b*, 108*b* are formed on downward sides in the rotation direction. Each blade 107, 108 is comprised of a leading edge 107*c*, 108*c* extending from the hub face 103*a* of the core portion 103 outward in the radius direction at the inlet side 130, a trailing edge 107*d*, 108*d* extending from the outer peripheral face 103*c* of the core portion 103 toward the inlet side 130 at the outlet side 140, and shroud 107*e*, 108*e* connecting the both edges 107*c*, 108*c*, 107*d*, 108*d*.

Because the compressor wheel 100 (particularly blade 102) is constituted of complicated three-dimensional curved surfaces, generally it is manufactured by precision casting such as lost wax casting process or machining such as cutting controlled under numerical control of five axes or more.

In recent years, the compressor wheel 100 has been demanded for intensified performance such as higher rotation number and high compression ratio (high pressure ratio) in order to improve combustion efficiency of an engine, purifying exhaust gas and for compactness (downsizing) accompanied by intensified function of automobile and engine. Thus, instead of a conventional aluminum made compressor wheel, a titanium compressor wheel having a higher mechanical strength has been sometimes adopted and a manufacturing method of the titanium compressor wheel has been disclosed in Japanese Patent Application Laid-Open No. 2004-52754 and U.S. Pat. No. 6,588,485.

These documents have disclosed following technologies. First, a positive pattern (near net shape male pattern) of wax or the like is created by adding a pad to a portion in which an insert die (die) generates a non-pullable pattern such as undercut. After that, lost wax casting is carried out with the positive pattern (near net shape) having the pad as a basic pattern. Further, only the pad portion of a cast titanium product (near net shape) is removed by cutting or the like and as a consequence, a titanium compressor wheel (net shape) of a complete pattern (final shape) is obtained. Therefore, according to this manufacturing method, manufacturing cost required for cutting and the like can be suppressed.

However, because according to the disclosed technology, only the portion having the pad of that cast titanium product is cut and a portion having no pad of the cast titanium product (that is, a portion in which the insert die can be pulled out, generating no undercut) is not cut, a probability that the non-cut portion of the cast titanium product (pullable portion) may not satisfy a predetermined dimensional allowance due to thermal stress or the like generated at the time of casting is increased. Accompanied by this dimensional deviation, dynamic balance is likely to deteriorate and often it takes a long time to correct rotation balance after a completion. Further, often a completed product becomes defective because it does not fall under such a dimensional allowance thereby reducing yield of products. In the meantime, if a compressor wheel is produced from a lump of titanium only by mechanical processing such as cutting, manufacturing cost increases because it is harder than aluminum, accompanying a difficulty in its processing.

SUMMARY OF THE INVENTION

An object of the present invention is to provide a manufacturing method of high precision titanium compressor wheel in which by removing pads attached on an entire surface entirely as a removing allowance (a machining allowance) in manufacturing process, dimensional accuracy at the time of manufacturing is intensified, and correction work of dynamic balance (rotation balance) is simplified or omitted so as to improve yield of products and suppress boosting of manufacturing cost.

To achieve the above-described object, according to an aspect of the present invention, there is provided a manufacturing method of titanium compressor wheel for manufacturing titanium compressor wheel, comprising:

positive pattern step of creating a positive pattern to be melted by heat formed in the shape of the compressor wheel so that pads having a predetermined thickness are provided on an entire outer surface as a removing allowance (a machining allowance) with respect to the final complete dimensions by means of a mold in which a plurality of movable insert dies are disposed radially so as to be concentrated on a center thereof; casting step of creating a cast titanium product to which the positive pattern is transferred with the pads given as the removing allowance (the machining allowance), with the positive pattern as a master form;

and removing step of removing portions corresponding to the pads of the cast titanium product obtained in the casting step entirely by machining processing.

To achieve the above-described object, according to another aspect of the present invention, there is provided a manufacturing method of titanium compressor wheel for manufacturing titanium compressor wheel, comprising: positive pattern step of creating a positive pattern with wax to be melted by heat formed in the shape of the compressor wheel so that pads having a predetermined thickness are provided on an entire outer surface as a removing allowance (a machining allowance) with respect to the final complete dimensions by means of a mold in which a plurality of movable insert dies are disposed radially so as to be concentrated on a center thereof; casting step of creating a cast titanium product to which the positive pattern is transferred with the pads given as the removing allowance (the machining allowance), with the positive pattern as a master form; and removing step of removing portions corresponding to the pads of the cast titanium product obtained by the casting step entirely by cutting and/or grinding.

According to these manufacturing methods, because the outer surface of the cast titanium product obtained by casting step are provided with the pads as the machining allowance, by removing portions corresponding to those pads entirely in removing step, dimensional deviation of the cast titanium product can be equalized, so that it can fall within a predetermined dimensional allowance relatively easily. Consequently, the dimensional accuracy at the time of processing of the titanium compressor wheel is intensified and the correction work of dynamic balance (rotation balance) can be simplified (for example, shortening adjustment time) or omitted. Further, by intensifying the dimensional accuracy at the time of the processing, the yield of products can be improved and a high precision titanium compressor wheel can be obtained. Because the portions corresponding to the pads are only removed by, for example, cutting at that time, the processing does not accompany difficulty as compared with a case of cutting from a lump of titanium material, thereby inducing no increase of manufacturing cost. In the meantime, "adjustment (correction) of dynamic balance (rotation balance)" means "forming a balance adjusting portion in a cast titanium product in order to reduce or diminish residual dynamic balance by adjusting mass distribution in the circumferential direction".

Because a positive pattern (wax pattern; male pattern) is created with wax in positive pattern step, a cast titanium product is created by casting with that wax pattern as a master form in casting step (lost wax casting process) and portions corresponding to the pads of the cast titanium product are removed by cutting and/or grinding, the cast titanium product can be produced at a high precision and thus, the thickness of the pads can be entirely reduced. Further, NC (five or more axes) control technology becomes easy to be introduced into removing step thereby making it possible to reduce time required for removing processing.

Further, to achieve the above-described object, according to still another aspect of the present invention, there is provided a manufacturing method of titanium compressor wheel for manufacturing titanium compressor wheel, comprising: positive pattern step of creating a positive pattern to be melted by heat formed in the shape of the compressor wheel so that pads having a predetermined thickness are provided on an entire outer surface as a removing allowance (a machining allowance) with respect to the final complete dimensions by means of a mold in which a plurality of movable insert dies are disposed radially so as to be concentrated on a center; positive pattern removing step of removing portions corresponding to the pads of the positive pattern entirely or partially with residual pad which is part thereof by removing processing; casting step of creating a cast titanium product to which the positive pattern is transferred with a positive pattern created by the positive pattern removing step as a master form; and cast product removing step of if the residual pad is left in the positive pattern removing step, removing portions corresponding to the residual pads of the cast titanium product obtained by the casting step by removing processing.

Because in the positive pattern removing step, portions corresponding to the pads are removed from the positive pattern (male pattern) such as milder wax pattern than cast titanium product entirely or with part of residual pads left, machining processing is easy. Further, because the cast titanium product does not need to be processed at all or hardly needs to be after casting step, the manufacturing time can be reduced. In the meantime, "removing partially with residual pads left" means "leaving the residual pads only at a predetermined position (specific portion) of the positive pattern".

According to these manufacturing method, preferably, in the positive pattern removing step, a predetermined portion of the compressor wheel is removed (machined) by cutting and/or grinding so that part of the thickness of the pad of the positive pattern is left as the residual pad while at the other portion of the compressor wheel, the pad of the positive pattern is removed (machined) entirely by cutting and/or grinding, and in the cast product removing step, a portion corresponding to the residual pad at the predetermined portion of the compressor wheel is removed from the cast titanium product by cutting and/or grinding.

In the case as a portion (specified portion) in which a residual pad is left in the positive pattern removing step and the portion corresponding to the residual pad is removed in cast product removing step, a portion requiring particularly precise dimensional accuracy, for example, a portion which affects directly the performance of the compressor wheel or a portion demanded for strict gap control, is set for example, like each portion at the inlet, dimensional deviation of cast titanium product based on thermal stress or the like generated in casting step can corrected by finish cutting in cast product removing step. If the dimensional accuracy is intensified in the cast product removing step, the correction work of dynamic balance (rotation balance) can be simplified or omitted and the yield of products can be improved. Conversely, because no finish cutting in cast product removing step is required for a portion in which necessary dimensional accuracy can be obtained by casting step (lost wax casting process), reductions of manufacturing time and manufacturing cost can be achieved.

More specifically, the "specified portion", that is, preferably, "the portion in which the residual pad is to be left in positive pattern removing step" includes:

end face of the front boss portion;

shrouds of blades and trailing edges;

outer peripheral face and rear face of core portion; and end face and outer peripheral face of rear boss portion (see FIG. 1).

In the meantime, "made of titanium" mentioned in the present invention includes made of pure titanium and made of titanium alloy. The same thing can be said of "cast titanium product" and "titanium material." Further, "removing processing" includes the following processing methods.

(1) Mechanical machining: cutting (turning, milling, broaching and the like), grinding, buffing, barrel finishing, blasting (shot blasting, sand blasting and the like), and ultrasonic machining;
(2) Electric machining: electrical discharge machining, electron beam machining, ion beam machining, plasma machining;
(3) Electrochemical machining: electrolytic machining, electrolytic grinding, electrolytic polishing;
(4) Chemical processing: chemical polishing, etching, chemical milling, etc; and
(5) Optical machining: laser beam machining, etc.

DESCRIPTION OF THE PREFERRED EMBODIMENTS

First Embodiment

Figure 1:
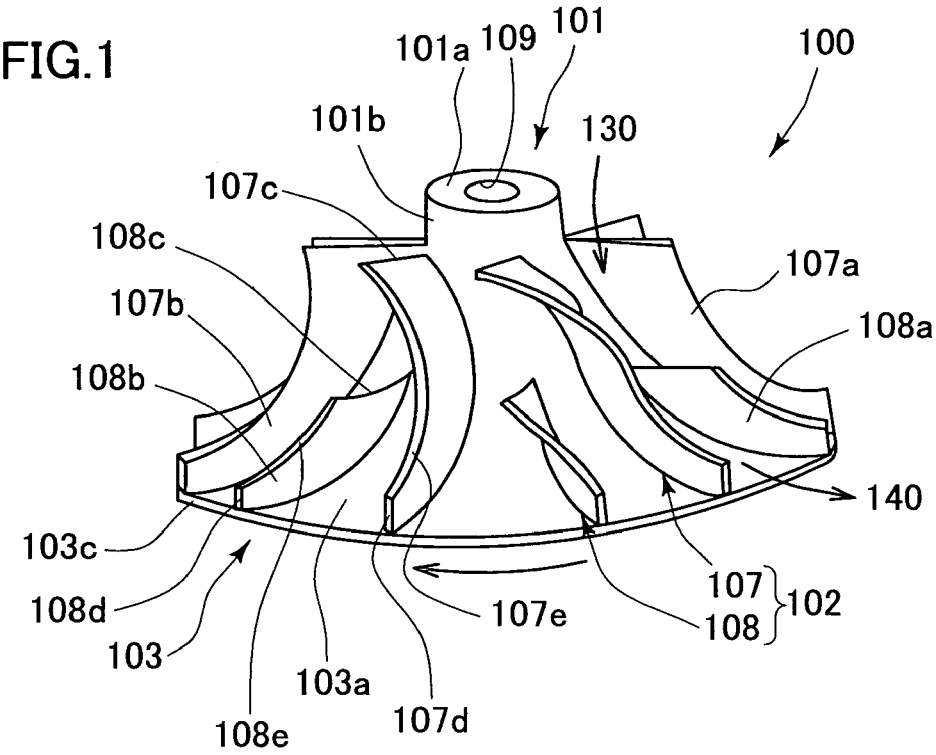
FIG. 1 is a schematic perspective view of a titanium compressor wheel.

Next, the manufacturing method of the titanium compressor wheel described in FIGS. 1, 2 will be described with reference to an embodiment of the present invention shown in FIGS. 3 to 14. According to this embodiment, the manufacturing method of the titanium compressor wheel of the present invention includes following three steps.

(1) Positive pattern step (see FIGS. 3, 4) for creating a wax pattern 10 (positive pattern; master pattern; male pattern) to be melted by heat, in which the shape of a compressor wheel 100 is formed to provide entirely an outer face of the compressor wheel (see FIG. 1) with pads 19 having a predetermined thickness as a machining allowance (a removing allowance), by means of a mold 1 so constructed that a plurality of movable insert dies are arranged radially such that they are concentrated to a center.
(2) Casting step for creating a cast titanium product 20 to which a wax pattern 10 is transferred according to lost wax casting process, with the pads 29 provided as the machining allowance, with the wax pattern 10 as a master form (see FIGS. 5 to 10)
(3) Machining step (Removing step; see FIGS. 11 to 14) for creating a compressor wheel 100 of a final complete configuration by removing entirely portions 29 corresponding to the pads of cast titanium product 20 by cutting (machining)

Each step will be described as follows.

(1) Positive Pattern Step

Figure 3:
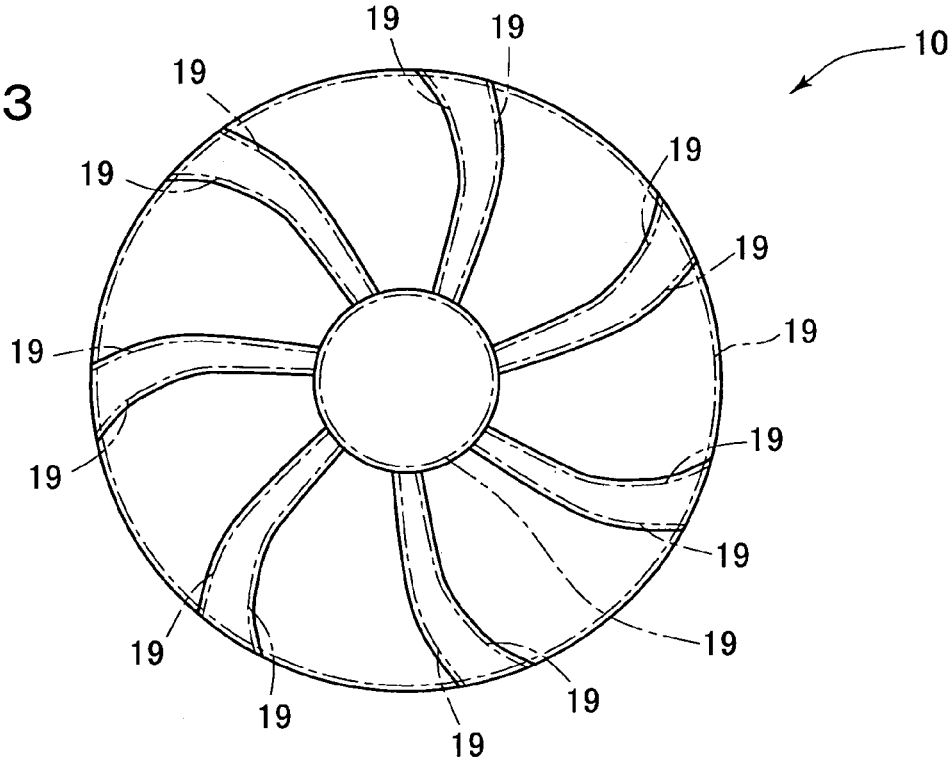
FIG. 3 is an explanatory diagram showing a wax pattern created in positive pattern step according to a manufacturing method of the titanium compressor wheel of the present invention as seen in its plan view.
Figure 4:
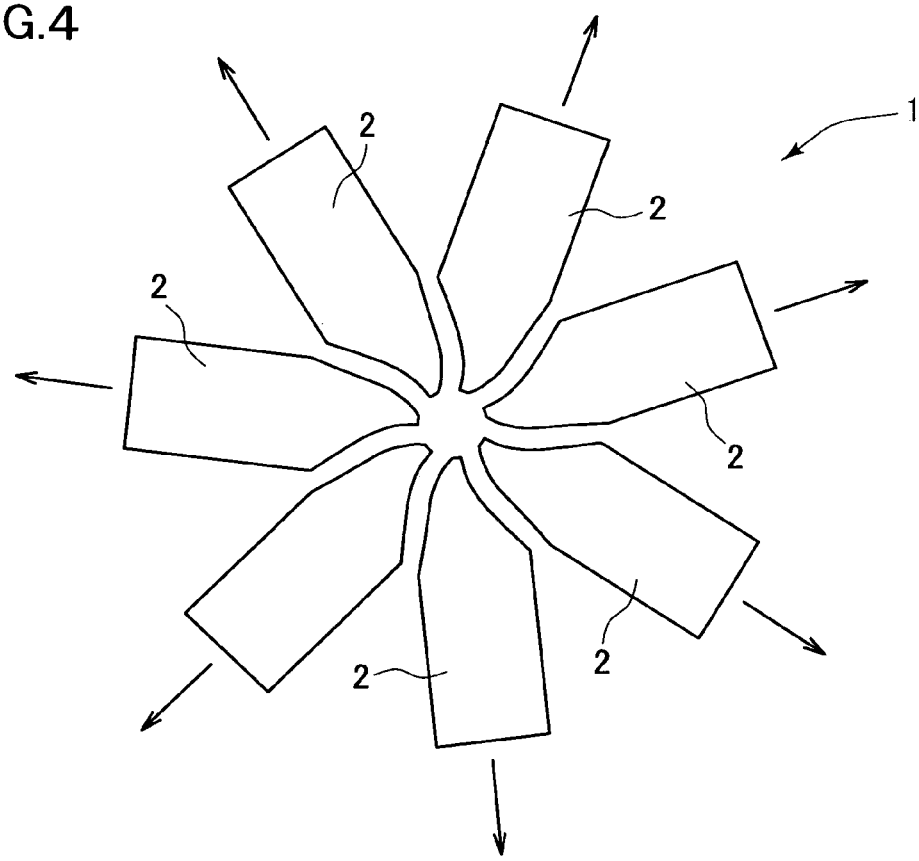
FIG. 4 is an explanatory diagram showing the arrangement of molds for creating the wax pattern of FIG. 3 as seen in its plan view.

As shown in FIG. 4, a die 1 in which the shape of a compressor wheel 100 (see FIG. 1) is formed with the plurality of (for example, 7) insert dies 2 arranged radially is constructed and melted wax is poured therein. At this time, for each of the insert dies 2 to be capable of separating and moving outward in a radius direction without generating a non-pullable condition such as undercut, the wax pattern 10 shown in FIG. 3 is created with the pads 19 being provided on entirely on the outer surface of the compressor wheel 100 (see FIG. 1) as the final complete configuration. Although in the mold 1 shown in FIG. 4 only seven insert dies 2 disposed between full blades 107 are expressed, actually, it is preferable to dispose 14 insert dies 2 considering an existence of the splitter blade 108 (see FIG. 1).

(2) Casting Step

Figure 5:
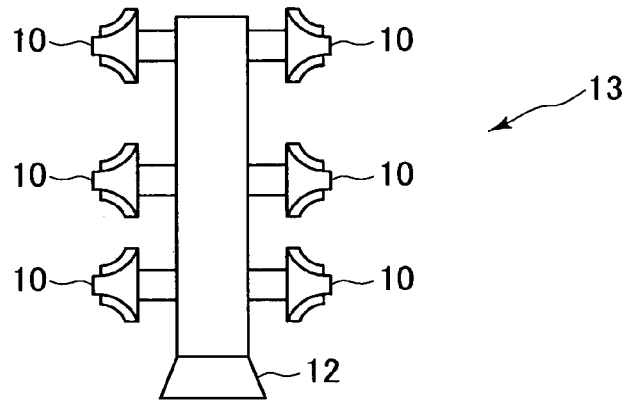
FIG. 5 is an explanatory diagram showing casting step subsequent to FIG. 3.
Figure 6:
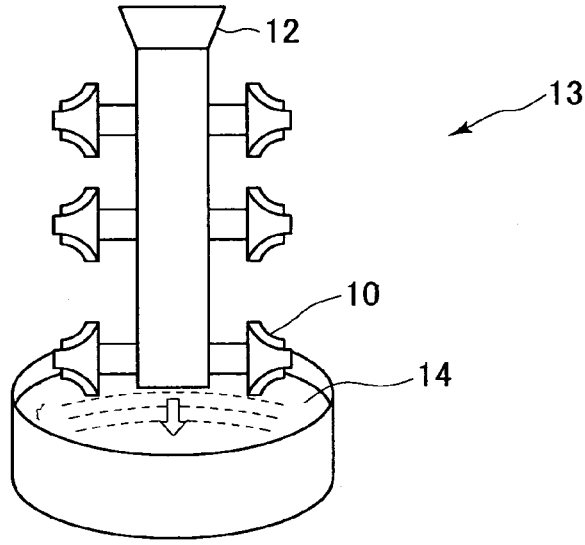
FIG. 6 is an explanatory diagram showing a casting step subsequent to FIG. 5.
Figure 7:
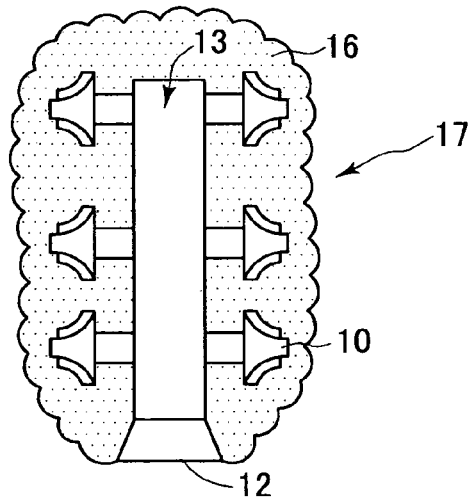
FIG. 7 is an explanatory diagram showing a casting step subsequent to FIG. 6.
Figure 8:
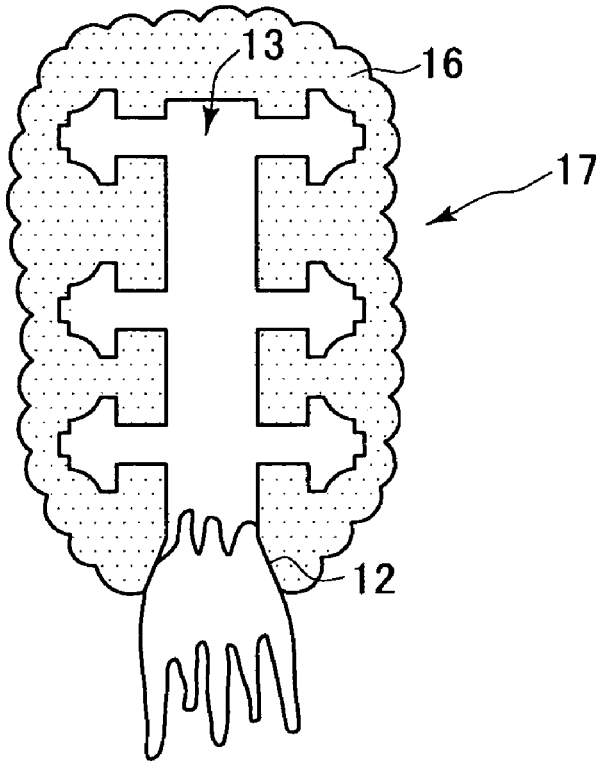
FIG. 8 is an explanatory diagram showing a casting step subsequent to FIG. 7.

Next, a cast titanium product 20 is created according to lost wax casting process with the wax pattern 10 shown in FIG. 3 as a master form. More specifically, as shown in FIG. 5, a plurality of (for example, 6) wax patterns 10 are assembled to a single sprue gate 12 in a tree fashion so as to construct a wax pattern tree 13. Next, as shown in FIG. 6, the wax pattern tree 13 is dipped into a slurry-like fire resisting binder 14 (dipping). Further, coarse fire resisting grains are sanded and hardened by drying (sanding). By repeating the dipping and sanding plural times (for example, 5 to 10 times), a shell-like die 17 covered with fire resisting coating layer 16 as shown in FIG. 7 is created.

Figure 9:
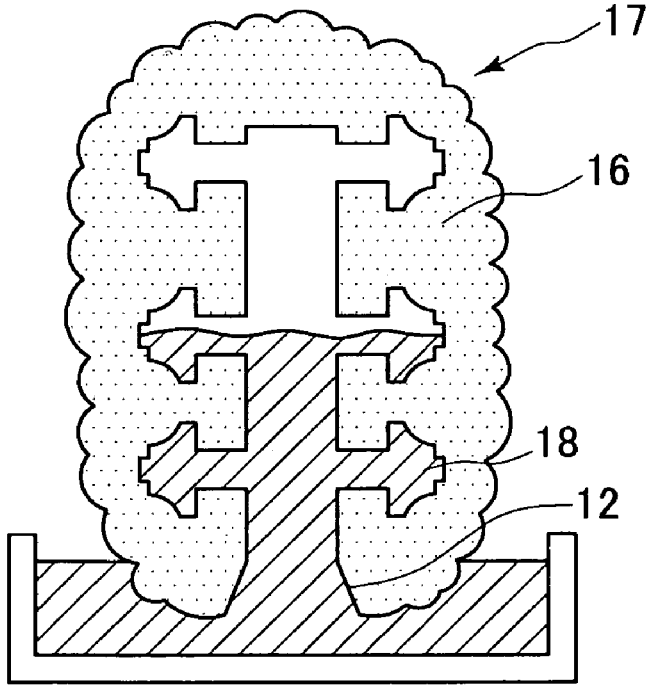
FIG. 9 is an explanatory diagram showing a casting step subsequent to FIG. 8.

Then, by heating the die 17 with water vapor with the sprue gate 12 down, wax in the wax pattern tree 13 (wax pattern 10) is eluted (dewaxing). Further, the die 17 is baked in a furnace so as to be given a strength and after that, as shown in FIG. 9, melted titanium material 18 is sucked through a sprue gate 12 for casting (suction method). After titanium material 18 is cooled and hardened, and removal of sand, cutting and the like are carried out, so that a cast titanium product 20 having the portion 29 corresponding to the pads entirely (on an entire surface) is fetched out. This cast titanium product 20 is comprised of a cast core portion 23 (core portion), cast blades (blade portion) which are formed on the cast core portion 23, constituted of cast full blades 27 and cast splitter blades 28, and front cast boss portion 21 (boss portion) and rear cast boss portion 24 (boss portion) which are formed on front end portion and rear end portion of the cast core portion 23 and coaxial with a rotation thereof to be mounted to the rotation shaft 300 (see FIG. 2).

(3) Machining Step

Figure 10:
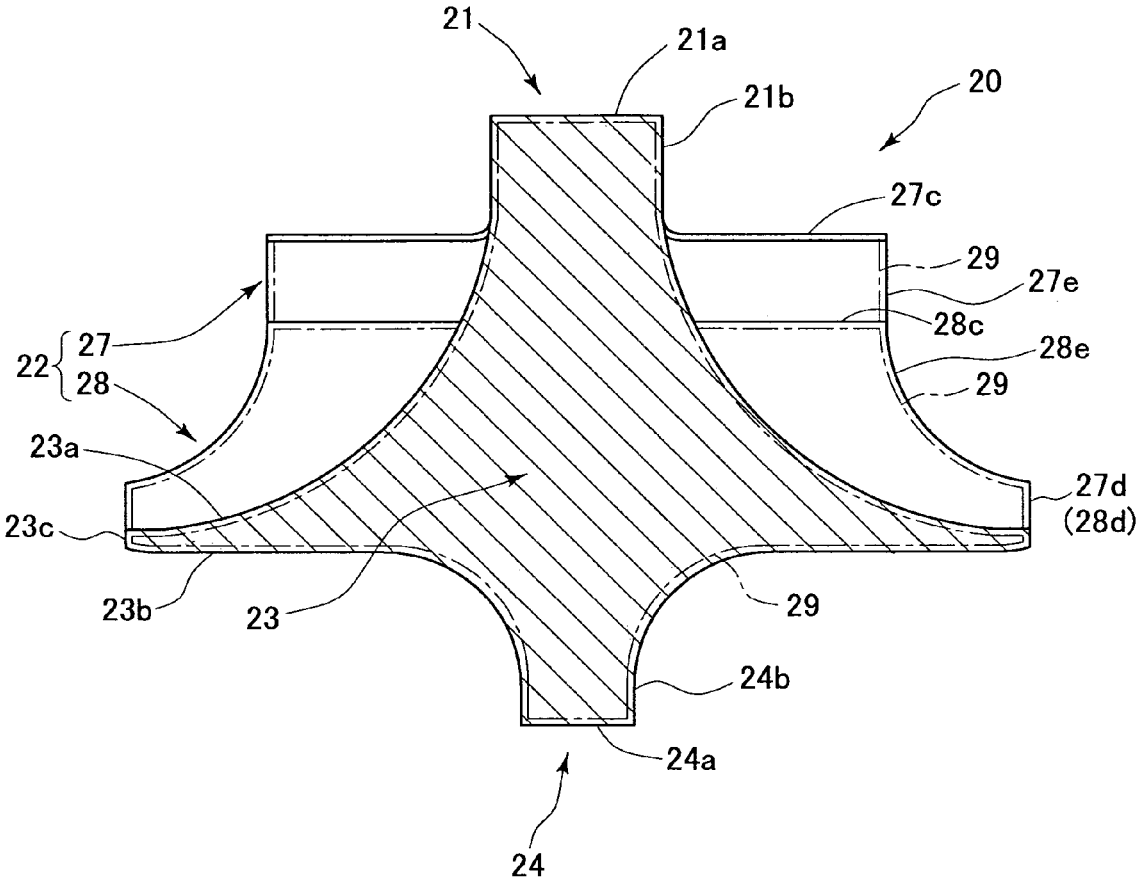
FIG. 10 is a sectional view of a cast titanium product created in the casting step of FIG. 9.
Figure 11:
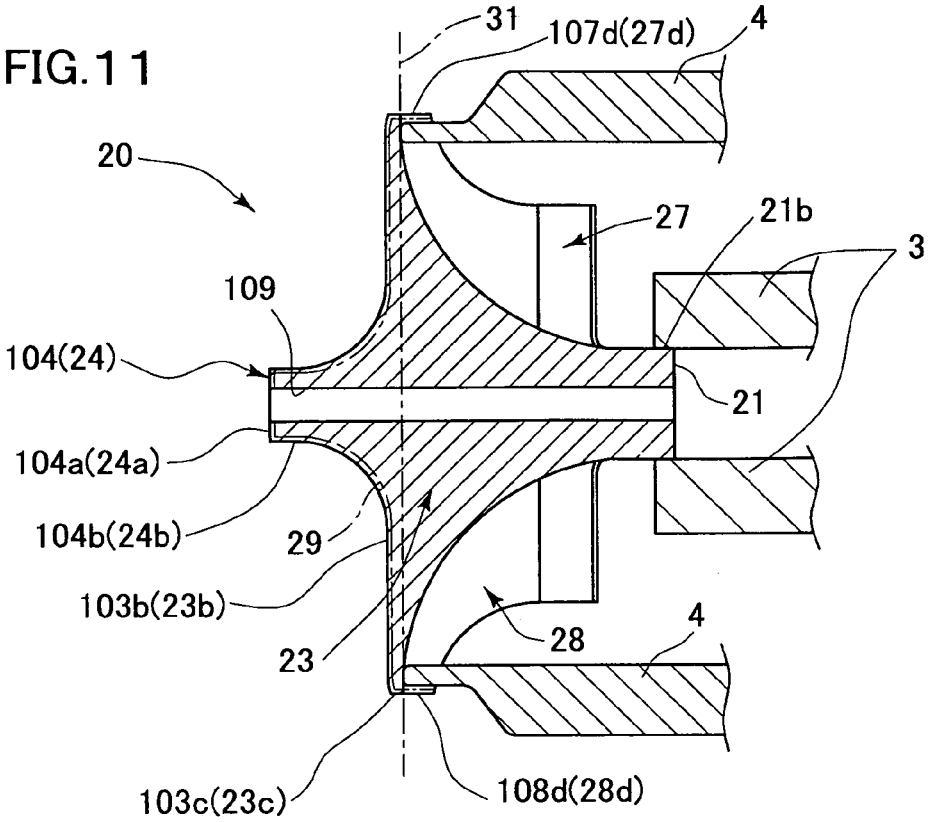
FIG. 11 is an explanatory diagram showing a removing step subsequent to FIG. 9.

By cutting the cast titanium product 20 shown in FIG. 10, the portion 29 corresponding to the pads is removed entirely to create the compressor wheel 100 of the final complete configuration (see FIG. 1). More specifically, as shown in FIG. 11, an outer peripheral face 21*b* of the front cast boss portion 21 is fixed with a chuck 3 of a lathe (not shown). A plurality (for example, 7) of receiving plates 4 projected from the lathe side are positioned between the respective cast blades 22 and their front ends are pressed against the disc-like, large-diameter front end face 31 formed on a rear half portion of the cast core portion 23. With the large-diameter front end face 31 of the cast core portion 23 and the outer peripheral face 21*b* of the front cast boss portion 21 as reference planes, the cast titanium product 20 is held and rotated by the chuck 3 and the receiving plates 4.

With this condition, by turning the end face 24*a* and the outer peripheral face 24*b* of the rear cast boss portion 24, the rear face 23*b* and an outer peripheral face 23*c* of the cast core portion 23, and the trailing edges 27*d*, 28*d* of the cast full blades 27 and the cast splitter blades 28, the portions 29 corresponding to the pads at these portions are removed from the cast titanium product 20. Then, the rear cast boss portion 24 turns to the rear boss portion 104 (boss portion) of the final complete configuration. At the same time when the portions 29 corresponding to the pads are removed by turning, a shaft hole 109 is formed, this hole going through the rear cast boss portion 24, the cast core portion 23 and the front cast boss portion 21.

Figure 12:
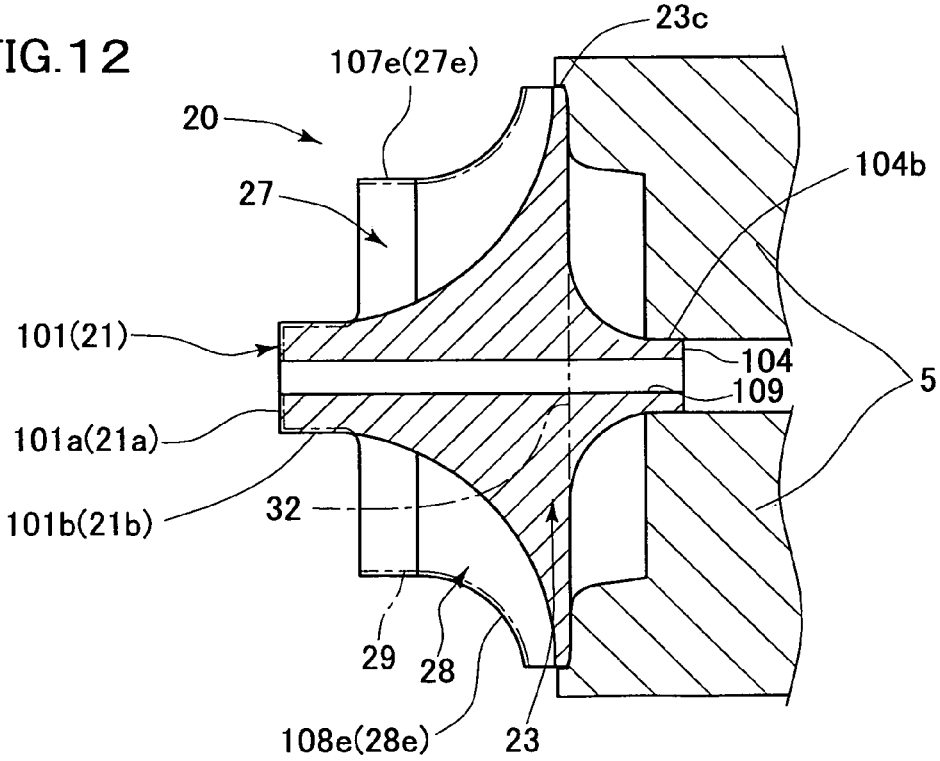
FIG. 12 is an explanatory diagram showing a removing step subsequent to FIG. 11.

Next, as shown in FIG. 12, the front and rear portions of the cast titanium product 20 are inverted and then, the outer peripheral face 23*c* of the cast core portion 23 is fixed with other chucks of the lathe. In this case, with the large-diameter rear end face 32 of the cast core portion 23 and the outer peripheral face 104*b* of the rear boss portion 104 as reference planes, the cast titanium product 20 is held and rotated by the chucks 5.

By turning the end face 21*a* and the outer peripheral face 21*b* of the front cast boss portion 21 and the shrouds 27*e*, 28*e* of the cast full blade 27 and the cast splitter blade 28 and the like with this condition, the portions 29 corresponding to the pads are removed from the cast titanium product 20. Then, the front cast boss portion 21 turns to the front boss portion 101 (boss portion) of the final complete configuration. In this way, mainly the portions 29 corresponding to the pads on the rear side (bask side) of the cast titanium product 20 are removed in FIG. 11 and in FIG. 12, mainly the portions 29 corresponding to the pads on the front side of the cast titanium product 20 are removed.

Figure 13:
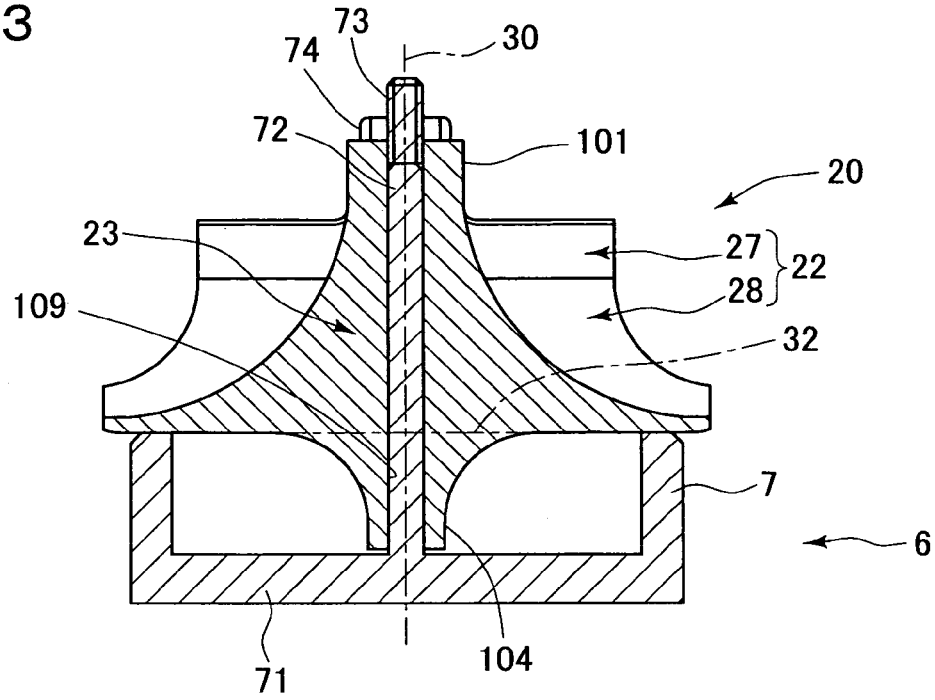
FIG. 13 is an explanatory diagram showing a removing step subsequent to FIG. 12.
Figure 14:
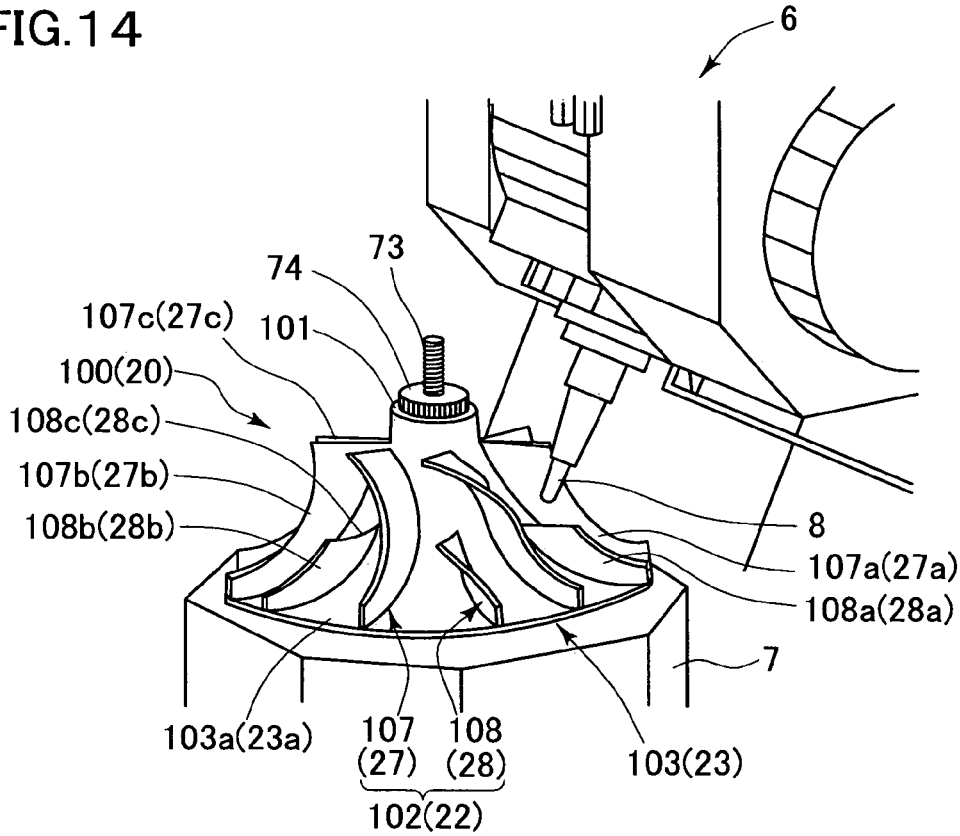
FIG. 14 is an explanatory diagram showing a removing step subsequent to FIG. 13.

Here, the cast titanium product 20 is moved from a lathe to a milling machine 6 shown in FIGS. 13, 14 and next, milling (machining processing) is executed. As shown in FIG. 13, a jig 7 of the milling machine 6 comprises a supporting base 71 for supporting the cast titanium product 20 from downward and a fixing shaft 72 erected vertically from the supporting base 7*a*. Then, the fixing shaft 72 of the milling machine 6 (jig 7) is inserted into the shaft hole 109 in the cast titanium product 20 so as to mount the cast titanium product 20 on the supporting base 71 so that the large-diameter rear end face 32 (reference face) of the cast core portion 23 is horizontal, and a female screw portion 74 such as a nut is fastened to a male screw portion 73 formed at a front end portion of the fixing shaft 72. As a consequence, the cast titanium product 20 is fixed on and held by the milling machine 6 (jig 7) such that the axis of the boss portions 101, 104 of the cast titanium product 20 align with a processing center line (a plumb line indicated with reference numeral 30) of the milling machine 6 (jig 7).

The milling machine 6 has a plurality (for example, five axes) of processing axes (dimensions). By cutting the pressure faces 27*a*, 28*a*, the negative pressure faces 27*b*, 28*b* and the leading edges 27*c*, 28*c* of the cast full blade 27, the cast splitter blade 28, and the hub face 23*a* of the cast core portion 23 and the like using one or plurality of processing axes and blade 8 as shown in FIG. 14, the portions 29 corresponding to the pads, not yet cut out are removed from the cast titanium product 20. Then, the cast blade 22 turns to the blade 102 (blade portion) of the final complete configuration and the cast core portion 23 turns to the core portion 103 of the final complete configuration. As a consequence, the portions 29 corresponding to the pads shown in FIG. 10 are removed entirely from the cast titanium product 20.

Figure 2:
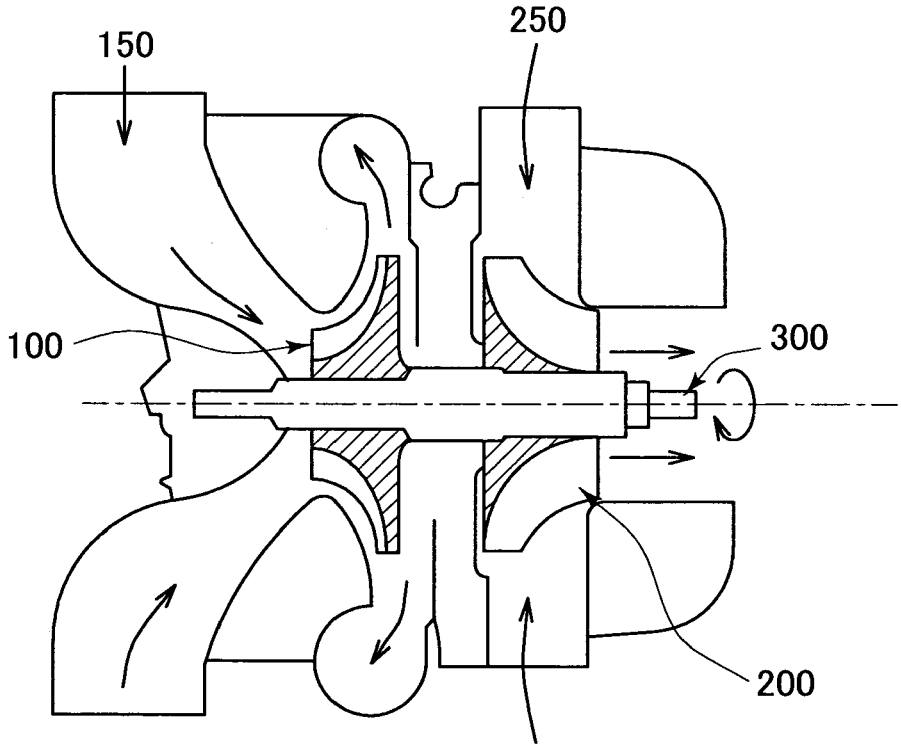
FIG. 2 is an explanatory diagram showing an example of a turbo charger using the titanium compressor wheel.

After finished to the final complete configuration (net shape), the titanium compressor wheel 10 (see FIG. 1) is used, for example, in the automobile turbocharger described about FIG. 2.

By removing entirely the portions 29 corresponding to the pads from the outside surface of the cast titanium product 20 in the machining step, dimensional deviation of the cast titanium product 20 can be equalized to be fallen into a predetermined dimensional allowance relatively easily. Because the dimensional accuracy at the time of processing of the titanium compressor wheel 100 is intensified as a result, if adjustment time is shortened, correction work of dynamic balance (rotation balance) can be simplified and if the adjustment becomes unnecessary, that correction work can be omitted. Further, by intensifying the dimensional accuracy at the time of processing, the yield of products can be improved so as to obtain a high precision titanium compressor wheel 100. Because at that time, the portions 29 corresponding to the pads are removed by cutting, high precision and high efficiency machining processing can be achieved by introducing NC (with five axes or more) control technology to suppress increase of manufacturing cost.

Second Embodiment

Figure 15:
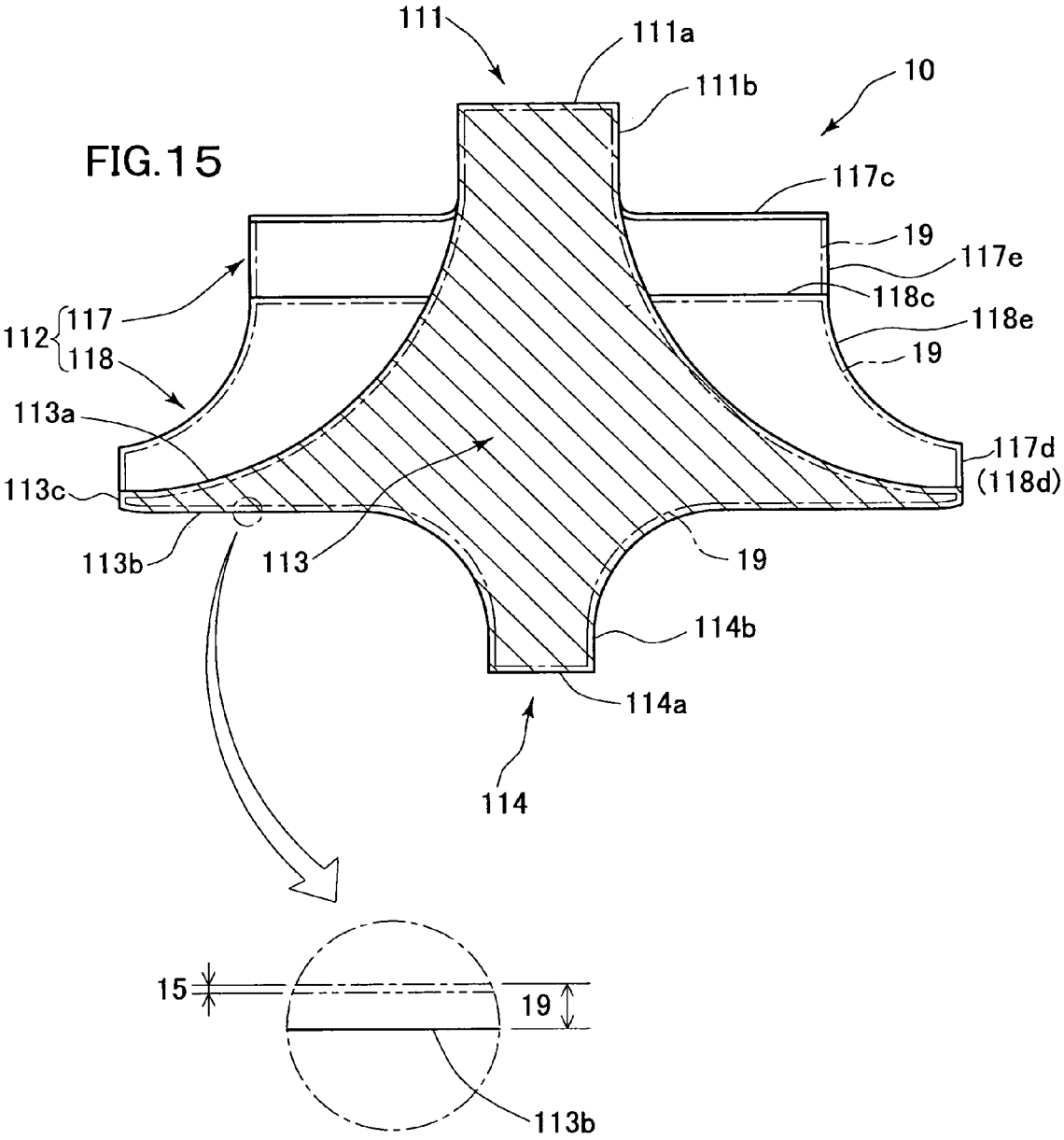
FIG. 15 is a sectional view of FIG. 3.
Figure 20:
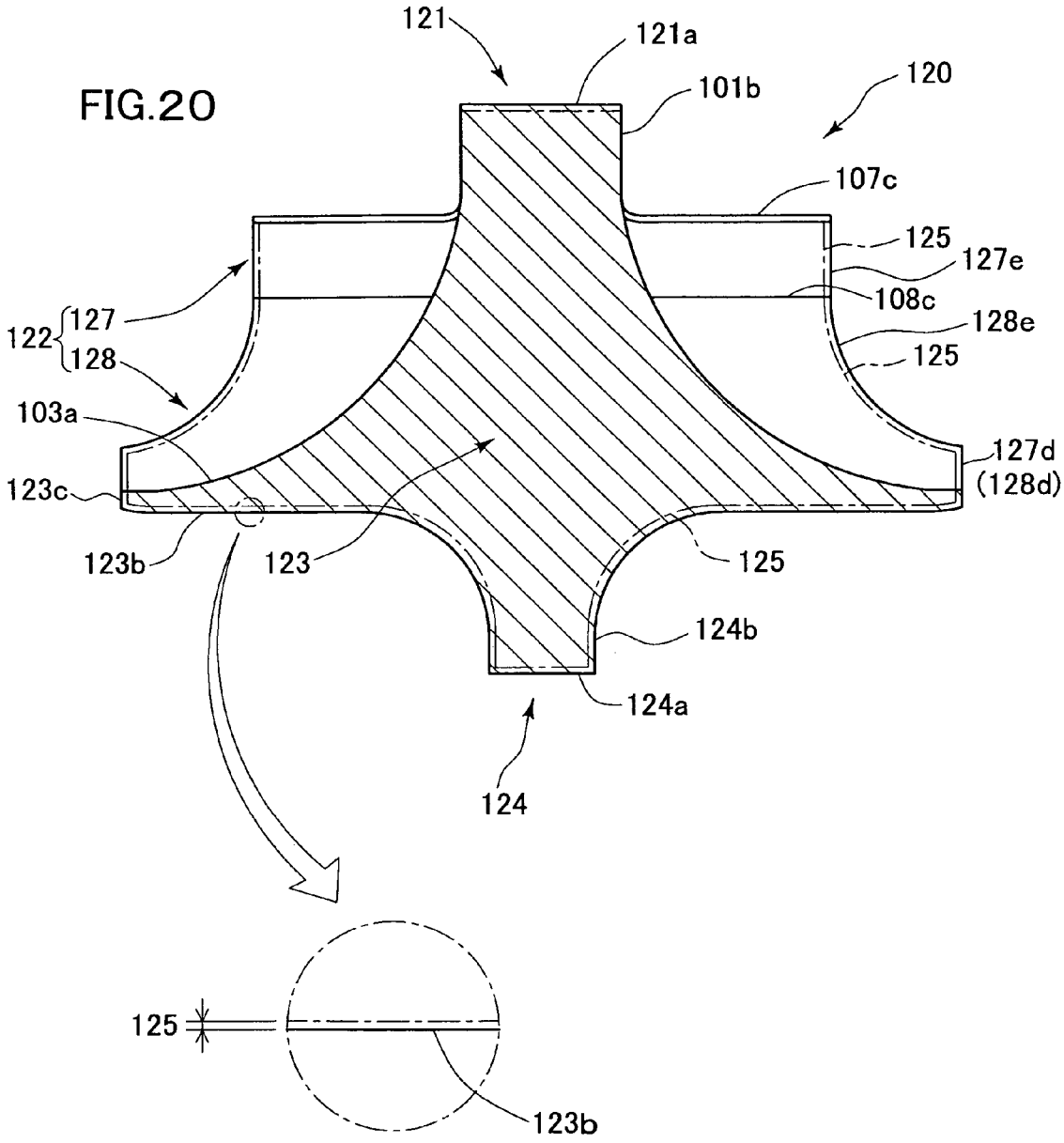
FIG. 20 is a sectional view of a cast titanium product created in the casting step.
Figure 21:
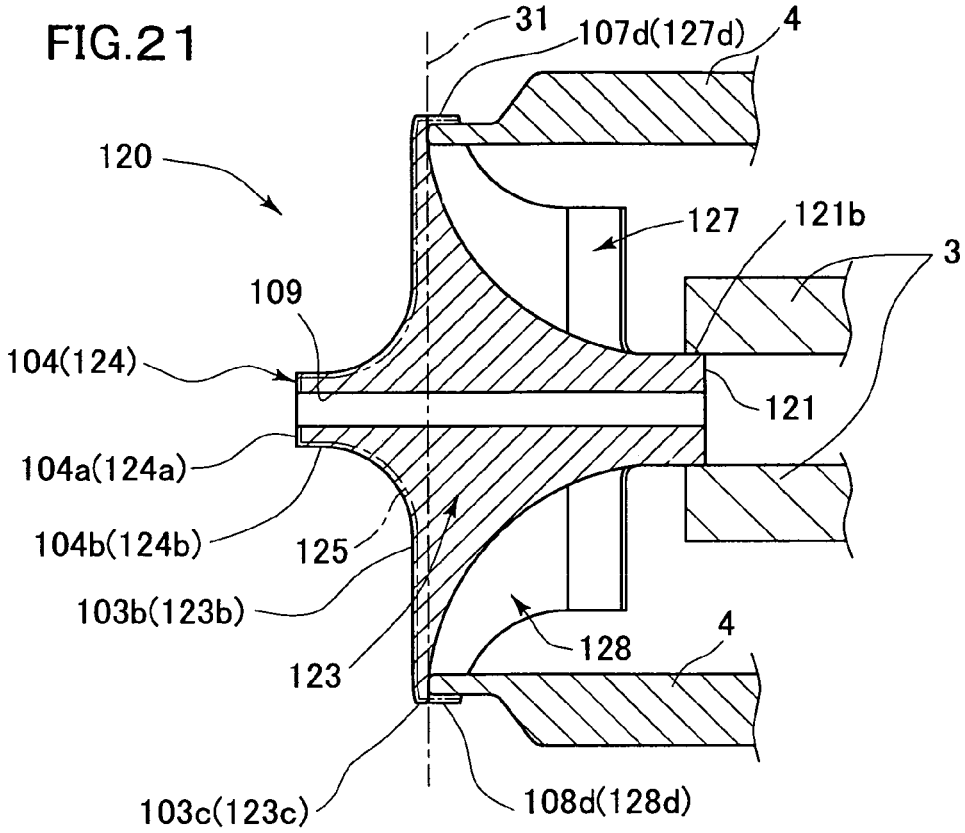
FIG. 21 is an explanatory diagram showing cast product removing step to a cast titanium product of FIG. 20.
Figure 22:
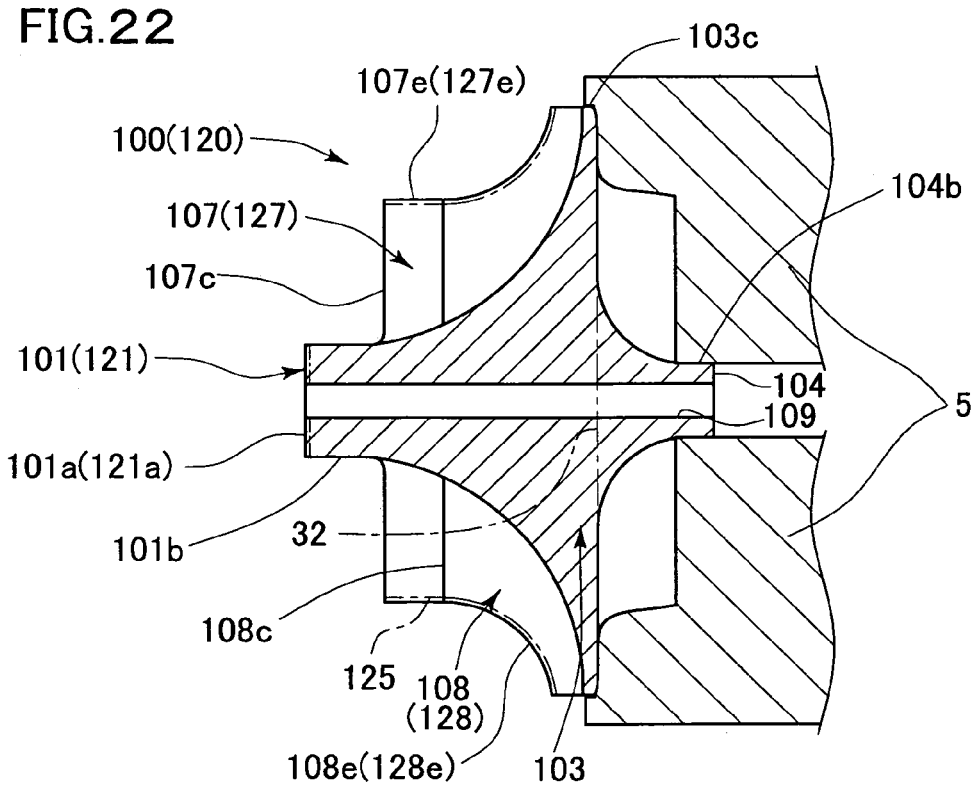
FIG. 22 is an explanatory diagram showing a cast product removing step subsequent to FIG. 21.

Next, another embodiment of the manufacturing method of the titanium compressor wheel described in FIGS. 1, 2 will be explained with reference to FIGS. 15 to 22. According to this embodiment, the manufacturing method of the titanium compressor wheel of the present invention includes following steps:

(1) Positive pattern step for creating a wax pattern 10 (positive pattern; master form; male pattern) provided entirely with pad 19 having a predetermined thickness as a machining allowance (a removing allowance) using a mold 1 comprised of a plurality of movable insert dies 2 (see FIGS. 3, 4, and 15);

(2) Positive pattern machining step (Positive pattern removing step) for creating a cast wax pattern 110 (positive pattern; master form; male pattern) by removing the portions 19 corresponding to the pads of the wax pattern 10 partially by machining processing such as cutting with residual pads 15 left (see FIGS. 16 to 19);

(3) Casting step for creating a cast titanium product 120 to which the cast wax pattern 110 is transferred according to the lost wax casting process by using the cast wax pattern 110 as a master form (see FIGS. 5 to 9, 20); and (4) Cast product machining step (Cast product removing step) for creating the compressor wheel 100 of the final complete configuration by removing the portions 125 corresponding to the residual pads of the cast titanium product 120 (see FIGS. 21, 22). Because the positive pattern step is the same as the first embodiment, about respective steps subsequent to the positive pattern machining step, mainly a section different from the first embodiment will be described.

(2) Positive Pattern Machining Step

FIG. 15 shows a sectional view of the wax pattern 10 (see FIG. 3) having portions 19 corresponding to the pads entirely (on the entire surface), which are created in the positive pattern step. This wax pattern 10 comprises a wax core portion 113 (core portion) extended outward in the radius direction, wax blades 112 (blade portion) which are formed on the wax core portion 113, including wax full blades 117 and wax splitter blades 118 and front wax boss portion 111 (boss portion) and rear wax boss portion 114 (boss portion), which are formed on the front end portion and rear end portion of the wax core portion 113 so as to be mounted on the rotary shaft 300 (see FIG. 2) and coaxial with a rotation center thereof.

Figure 16:
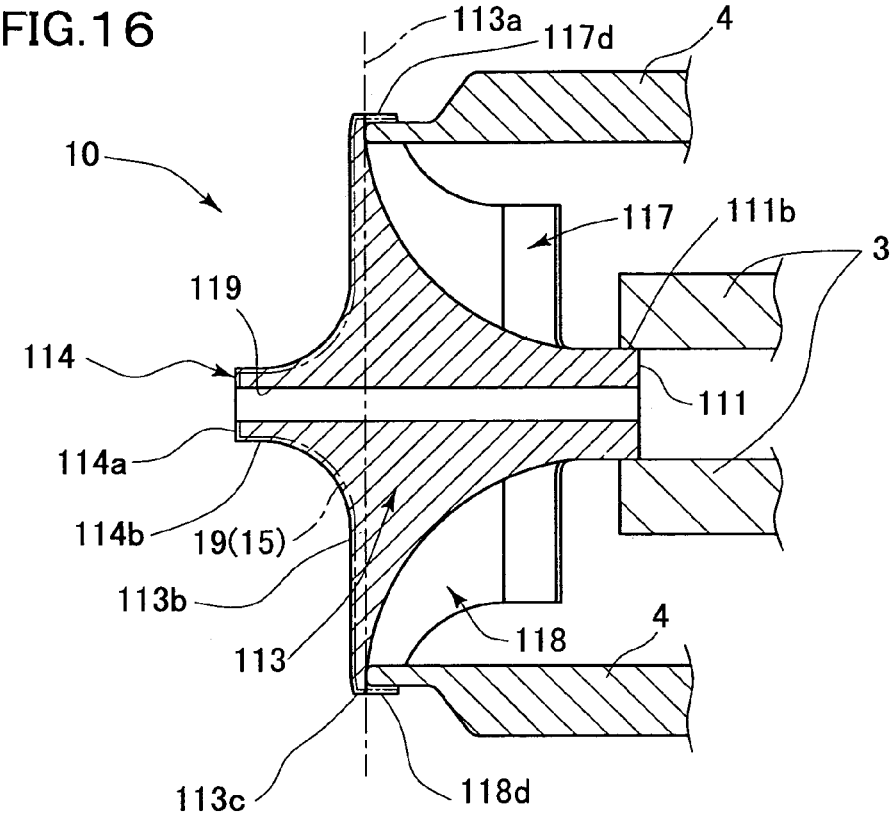
FIG. 16 is an explanatory diagram showing a positive pattern removing step in other manufacturing method of the titanium compressor wheel of the present invention.

The cast wax pattern 110 is created by cutting the wax pattern 10 shown in FIG. 15 with part of the residual pads 15 left. More specifically, as shown in FIG. 16, an outer peripheral face 111*b* of the front wax boss portion 111 of the wax pattern 10 is fixed with the chucks 3 of a lathe (not shown). A plurality of (for example, seven) receiving plates 4 projecting from the lathe side are positioned between the wax blades 112 and the front ends are pressed against the disc-like large-diameter front end face 113*a* formed on the rear half portion of the wax core portion 113. Then, with the large-diameter front end face 113*a* of the wax core portion 113 and the outer peripheral face 111*b* of the front wax boss portion 111 as reference plane, the wax pattern 10 is held by the chucks 3 and the receiving plates 4 and rotated.

With this condition, by turning the end face 114*a* and the outer peripheral face 114*b* of the rear wax boss portion 114, the rear face 113*b* and the outer peripheral face 113*c* of the wax core portion 113, and the trailing edges 117*d*, 118*d* of the wax full blade 117 and wax splitter blade 118, the portions 19 corresponding to the pad of each portion are removed from the wax pattern 10 with part thereof (for example, 1 to 10% of the thickness of the pad) left as the residual pad 15 (see the enlarged view of FIG. 15). In the meantime, at the same time when the portions 19 corresponding to the pads are removed by turning, the wax shaft hole 119 is formed to go through the rear wax boss portion 114, the wax core portion 113 and the front wax boss portion 111.

Figure 17:
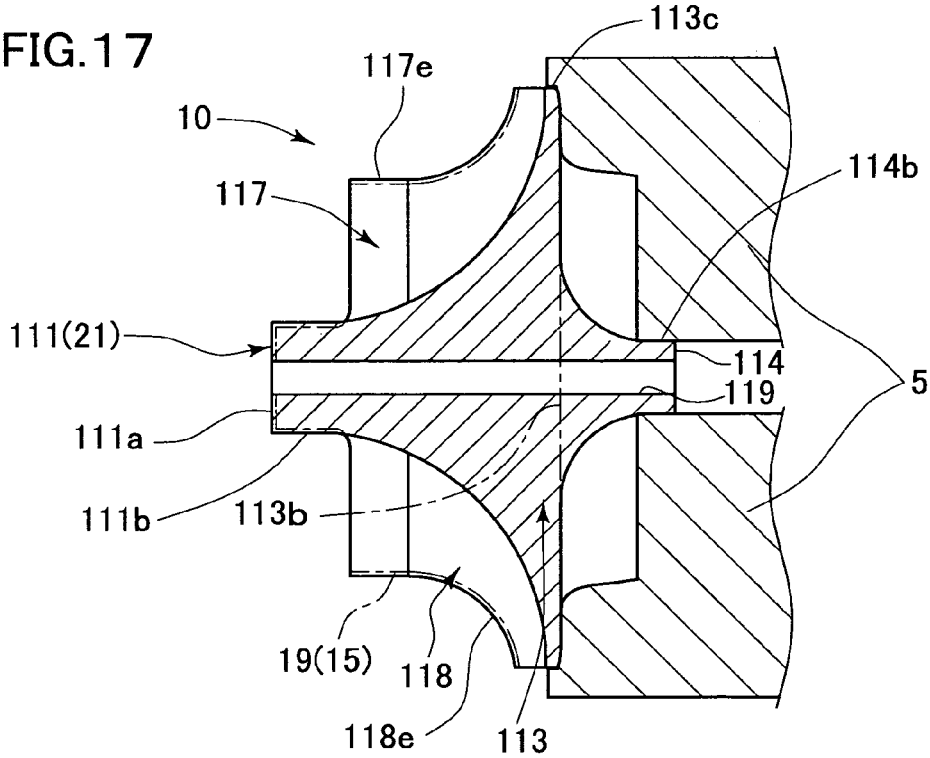
FIG. 17 is an explanatory diagram showing a positive pattern removing step subsequent to FIG. 16.

Next, as shown in FIG. 17, the front and rear portions of the wax pattern 10 are inverted and the outer peripheral face 113*c* of the wax core portion 113 is fixed with other chuck 5 of the lathe. Then, with the large-diameter rear end face 113*b* of the wax core portion 113 and the outer peripheral face 114*b* of the rear wax boss portion 114 as reference plane, the wax pattern 10 is held by the chuck 5 and rotated.

With this condition, by turning the end face 111*a* of the front wax boss portion 111*a*, the shrouds 117*e* of the wax full blades 117 and the shrouds 118*e* of the wax splitter blades 118, the portions 19 corresponding to the pad of each portion is removed from the wax pattern 10 with part thereof (for example, 1 to 10% of the thickness of the pad) left as the residual pad 15 (see the enlarged view of FIG. 15). As for the outer peripheral face 111*b* of the front wax boss portion 111, the portions 19 corresponding to the pads are removed from the wax pattern 10 by turning. In FIG. 16, the pads 19 of the rear side (back side) are removed from the wax pattern 10 and in FIG. 17, the pads 19 of the front side are removed from the wax pattern 10.

Figure 18:
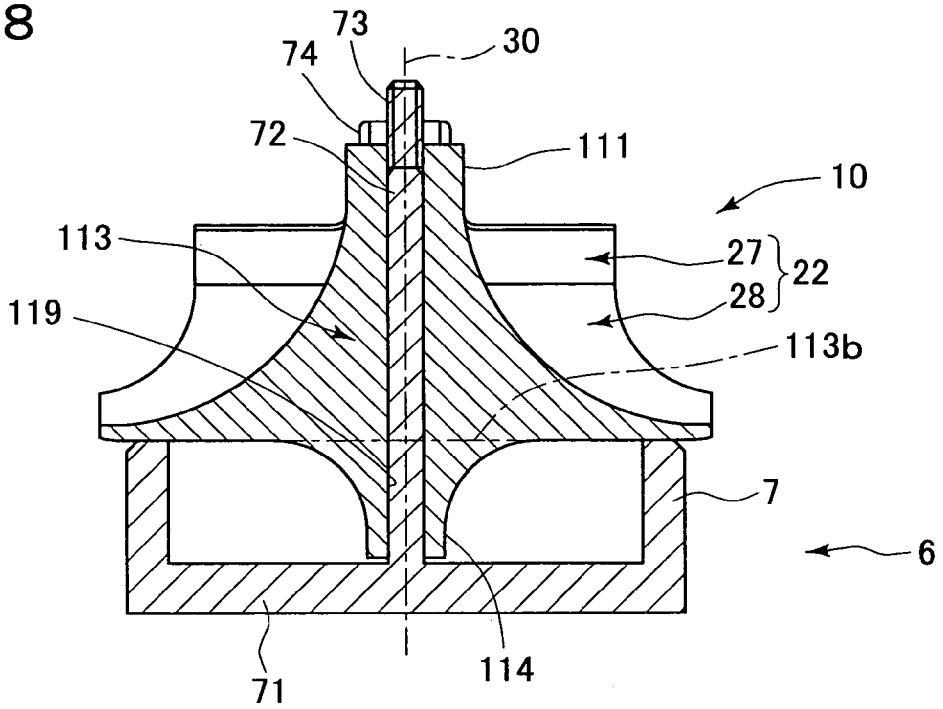
FIG. 18 is an explanatory diagram showing a positive pattern removing step subsequent to FIG. 17.
Figure 19:
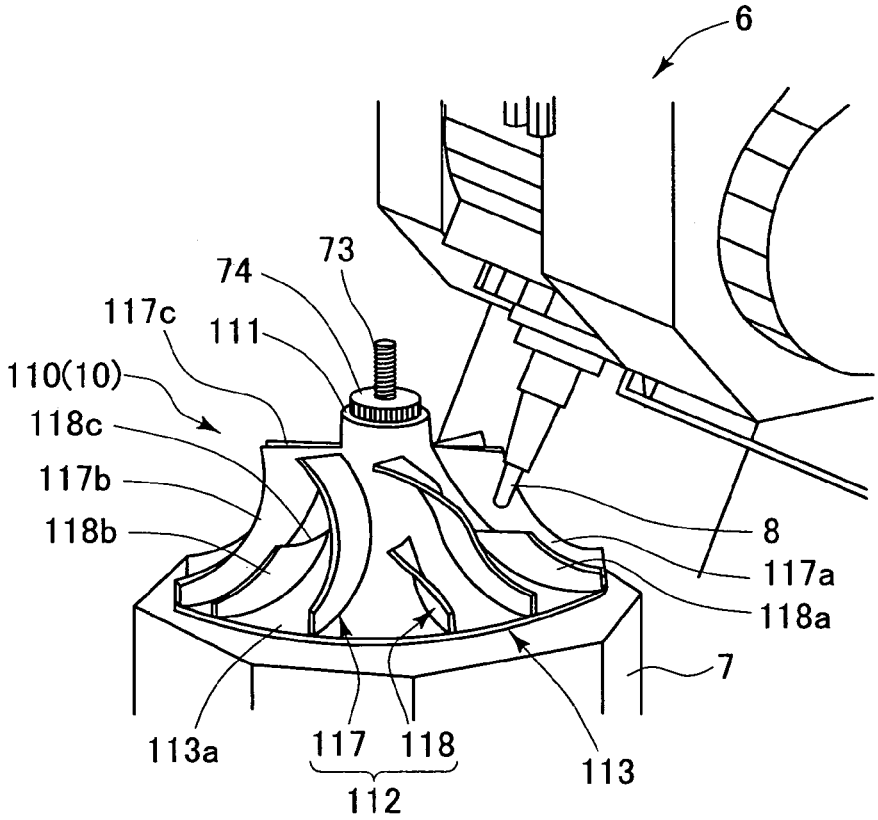
FIG. 19 is an explanatory diagram showing a positive pattern removing step subsequent to FIG. 18.

Here, the wax pattern 10 is moved from the lathe to the milling machine shown in FIGS. 18, 19 and milling (machining) is executed. As shown in FIG. 18, the jig 7 of the milling machine 6 comprises the supporting base 71 for supporting the wax pattern 10 from downward and the fixing shaft 72 erected vertically from the supporting base 71. Then, the fixing shaft 72 of the milling machine 6 (jig 7) is inserted into the wax shaft hole 119 in the wax pattern 10 and the wax pattern 10 is mounted on the supporting base 71 so that the large-diameter rear end face 113*b* (reference plane) of the wax core portion 113 is horizontal and then, the female screw 74 such as a nut is fastened to the male screw 73 formed at the front end portion of the fixing shaft 72. As a consequence, the wax pattern 10 is fixed on and held by the milling machine 6 (jig 7) such that the axis of the wax boss portions 111, 114 (wax shaft hole) of the wax pattern 10 aligns with the processing center of the milling machine 6 (jig 7 (a plumb line indicated with reference numeral 30).

The milling machine 6 has a plurality (for example, five axes) of processing axes (dimension). By cutting the pressure faces 117*a*, 118*a*, the negative pressure faces 117*b*, 118*b* and the leading edges 117*c*, 118*c* of the wax full blades 17 and the wax splitter blades 118 using one or a plurality of processing axes and the blade 8 as shown in FIG. 19, all thickness of the portions 19 corresponding to the pads are removed from portions not yet cut of the wax pattern 10. As a consequence, removing of the portions 19 corresponding to the pads shown in FIG. 15 from the wax pattern 10 is completed and then, the cast wax pattern 110 is completed.

As described above, the cast wax pattern 110 has part of the pads 19 as the residual pad 15 at following respective portions (a) to (d).

(a) End face 111*a* of the front wax boss portion 111;

(b) Shrouds 117*e*, 118*e* and trailing edges 117*d*, 118*d* of the wax blade 112;

(c) Outer peripheral face 113*c* and rear face 113*b* of the wax core portion 113; and (d) End face 114*a* and the outer peripheral face 114*b* of the rear wax boss portion 114.

These portions require particularly high dimensional precision, because some of them affect the performance of the compressor wheel 100 directly or in some case, a strict gap control is demanded relative to a wall portion of a casing at the time of installation. Then, a portion corresponding to the residual pad 15 is removed by finish cutting in cast product machining step described later. That is, the residual pad 15 has an important function for correcting the dimensional deviation of a cast titanium product based on thermal stress generated in casting step by finish cutting in the cast product machining step. In the meantime, because most portions in which the entire pads 19 are to be removed from the wax pattern 10 are portions which cannot be cut with anything but a milling machine, working time can be reduced if the cast product machining step is executed with only lathe operation.

(3) Casting Step

Next, with the cast wax pattern 1 10 completed in FIG. 19 used as a master form, the cast titanium product 120 is created according to the lost wax casting process. A specific procedure is the same as the casting step of the first embodiment and the cast wax pattern 110 is used instead of the wax pattern 10. In the meantime, according to this embodiment, casting work is carried out after both end portions of the wax shaft hole 119 are plugged with wax or the like.

(4) Cast Product Machining Step

FIG. 20 shows a sectional view of the cast titanium product 120 created in casting step and partially having the portion 125 corresponding to the residual pad. This cast titanium product 120 comprises cast core portion 123 (core portion) extending outward in the radius direction, cast blades 122 (blade portion) which are formed on the cast core portion 123 and constituted of cast full blades 127 and cast splitter blades 128 and front cast boss portion 121 (boss portion) and rear cast boss portion 124 (boss portion) formed on the front end portion and rear end portion of the cast core portion 123 so as to be mounted on the rotary shaft 300 (see FIG. 2) and coaxial with a rotation center thereof.

The residual pad 125 corresponding to the residual pad 15 of the cast wax pattern 110 are held at following portions (A) to (D).

(A) End face 121*a* of the front cast boss portion 121;

(B) Shrouds 127*e*, 128*e* and trailing edges 127*d*, 128*d* of cast blade 122;

(C) Outer peripheral face 123*c* and rear face 123*b* of cast core portion 123; and (D) End face 124*a* and outer peripheral face 124*b* of rear cast boss portion 124.

By cutting the cast titanium product 120 shown in FIG. 20, the portion 125 corresponding to the residual pad is removed to create the compressor wheel 100 of the final complete configuration (see FIG. 1). More specifically, as shown in FIG. 21, the outer peripheral face 121*b* of the front cast boss portion 121 of the cast titanium product 120 is fixed with the chuck 3 of a lathe (not shown). A plurality of the receiving plates 4 projecting from the lathe are positioned between the respective cast blades 122 and the front ends are pressed against the disc-like, large-diameter front end face 31 formed on the rear half portion of the cast core portion 123. Then, with the large-diameter front end face 31 of the cast core portion 123 and the outer peripheral face 121*b* of the front cast boss portion 121 as reference planes, the cast titanium product 120 are held by the chuck 3 and the receiving plates 4 and rotated.

With this condition, by turning the end face 124*a* and the outer peripheral face 124*b* of the rear cast boss portion 124, the rear face 123*b* and the outer peripheral face 123*c* of the cast core portion 123 and the trailing edges 127*d*, 128*d* of the cast full blade 127 and the cast splitter blade 128, the portions 125 corresponding to the residual pads at these portions are removed from the cast titanium product 120. Then, the rear cast boss portion 124 turns to the rear boss portion 104 (boss portion) of the final complete configuration and the cast core portion 123 turns to the core portion 103 of the final complete configuration. In the meantime, the shaft hole 109 is formed so as to go through the rear cast boss portion 124, the cast core portion 123 and the front cast boss portion 121.

Next, as shown in FIG. 22, the front and rear (front and back) portions of the cast titanium product 120 are inverted and the outer peripheral face 103*c* of the core portion 103 are fixed with other chuck 5 of the lathe. In this case, with the large-diameter rear end face 32 of the core portion 103 and the outer peripheral face 104*b* of the rear boss portion 104 as reference plane, the cast titanium product 120 is held by the chuck 5 and rotated.

With this condition, by turning the end face 121*a* of the front cast boss portion 121, the shroud 127*e* of the cast full blades 127 and the shroud 128*e* of the cast splitter blade 128, the portions 125 corresponding to the residual pads at these portions are removed from the cast titanium product 120. Then, the front cast boss portion 121 turns to the front boss portion 101 (boss portion) of the final complete configuration and the cast blade 122 turns to the blade 102 (blade portion) of the final complete configuration. In this way, in FIG. 21, mainly the portion 125 corresponding to the residual pad on the rear side of the cast titanium product 120 (back side) is removed. As a consequence, removing of the portion 125 corresponding to the residual pad shown in FIG. 20 from the cast titanium product 120 is completed.

The titanium compressor wheel 100 (see FIG. 1) of the second embodiment having such final complete configuration is used in the automobile turbocharger shown in FIG. 2 and the like, as the first embodiment.

Because in the positive pattern machining step, the portion corresponding to the pad is removed from the positive pattern (male pattern) such as milder wax pattern than the cast titanium product with partial residual pads left, the machining processing is easy. Further, because the cast titanium product does not need to be milled after casting step, the manufacturing time is reduced. Further, because the dimensional accuracy in the cast product machining step is intensified, the correction work of dynamic balance (rotation balance) is simplified (omitted), thereby improving the yield of products.

Third Embodiment

Figure 23:
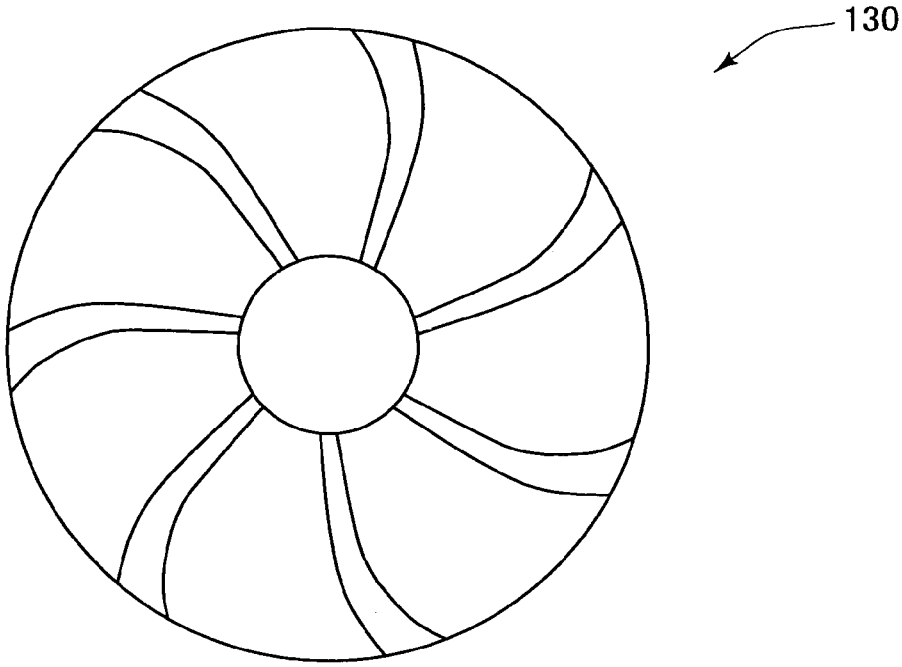
FIG. 23 is an explanatory diagram of a completed wax pattern created in positive pattern removing step in other manufacturing method of the titanium compressor wheel of the present invention as seen in its plan view.

Next, still another embodiment of the manufacturing method of the titanium compressor wheel described in FIGS. 1, 2 will be explained with reference to FIGS. 23, 24. According to this embodiment, the manufacturing method of the titanium compressor wheel of the present invention includes following three steps:

(1) Wax pattern 10 (positive pattern; master form; male pattern) provided entirely with the pads 19 having a predetermined thickness as a machining allowance (a removing allowance) by the mold 1 constituting of a plurality of movable insert dies 2 (see FIGS. 3, 4, and 15);

(2) Positive pattern machining (Positive pattern removing) step for creating a complete wax pattern 130 (final complete configuration positive pattern; master form; male pattern) of substantial final complete configuration by removing the portions 19 corresponding to the pads of the wax pattern 10 by cutting or the like (see FIGS. 16 to 19, 23); and (3) Casting step for creating a complete cast titanium product 140 of substantial final complete configuration according to the lost wax casting process with the complete wax pattern 130 as a master form (see FIGS. 5 to 9, 24).

Because of these steps, the positive pattern step is the same as the first and second embodiments, the positive pattern machining step and casting step will be described about mainly a portion different from the second embodiment.

(2) Positive Pattern Machining Step

The portions 19 (see FIGS. 3, 15) corresponding to the pads of the wax pattern 10 created in positive pattern step is removed entirely by cutting (see FIGS. 16 to 19) or the like. As a consequence, as shown in FIG. 23, the portion 19 corresponding to the pad is removed and then, a complete wax pattern 130 of substantial complete configuration is created.

(3) Casting Step

Figure 24:
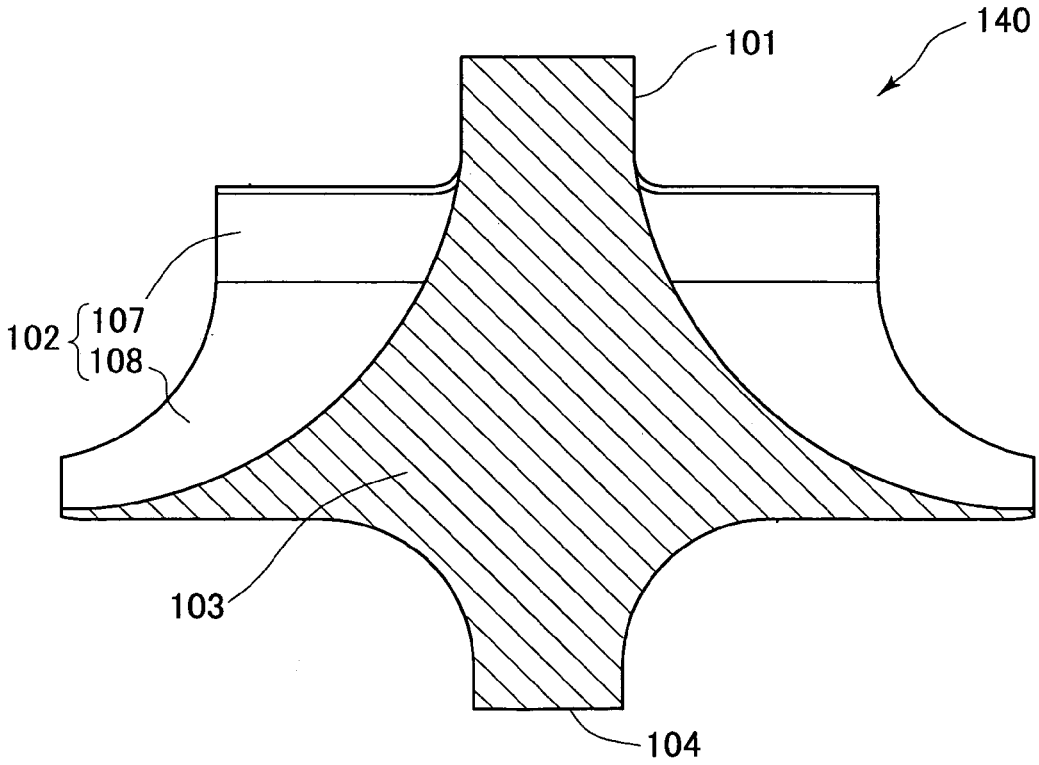
FIG. 24 is a sectional view of a completed cast titanium product created in the casting step subsequent to FIG. 23.

If with the complete wax pattern 130 as a master form, the lost wax casting process (see FIGS. 5 to 9) is carried out, the complete cast titanium product 140 of substantial final complete configuration is created as shown in FIG. 24. However, the complete cast titanium product 140 may sometimes need processing of the shaft hole 109 (see FIG. 11).

According to this embodiment, because the cast product machining step can be omitted by removing the portions 19 corresponding to the pads entirely from the wax pattern 10, the machining processing is easier than the second embodiment. Further, because the complete cast titanium product 140 hardly needs to be processed additionally, the manufacturing time is reduced.

Although the embodiments of the present invention have been described, the present invention can be modified in various ways or other matter can be added to the present invention upon carrying out the invention. For example, although the portions 19, 29 corresponding to the pads and the portions 15, 125 corresponding to the residual pads, formed in the wax pattern 10, the cast wax pattern 110 and the cast titanium products 20, 120 have been represented in a substantially equal thickness, they do not need to be provided evenly over entire portions. That is, the portions 19, 29 corresponding to the pads only need to be so shaped to allow manufacturing of the wax pattern 10 to be carried out without any undercut and the like and machining processing (removing processing) of the cast titanium product 20 to be carried out efficiently. Further, the portions 15, 125 corresponding to the residual pads only need to be so shaped to allow the machining processing (the removing processing) of the cast titanium product 120 to be carried efficiently in the cast product machining step.

In the meantime, the titanium compressor wheel manufactured according to the present invention can be used for an application of compressing exhaust gas and supplying to an engine cylinder for after-burning as well as an application of compressing suction air and supplying to the engine cylinder (see FIG. 2).

What is claimed is:

1. A manufacturing method for a titanium compressor wheel provided with blades, comprising:

a positive pattern step of creating a positive pattern including pads with wax to be melted by heat formed in the shape of said compressor wheel such that the pads having a predetermined thickness are cast on an entire outer surface, including the blades, as a removing allowance with respect to the final complete dimensions, by means of a mold in which a plurality of movable insert dies are disposed radially so as to be concentrated on a center thereof;

a casting step of creating a cast titanium product to which said positive pattern is transferred with said pads given as the removing allowance, with the positive pattern as a master form; and a removing step of removing portions corresponding to said pads of the cast titanium product obtained by the casting step entirely by cutting and/or grinding.

* * * * *